US005456506A

United States Patent [19]

Bartlett

[11] Patent Number: 5,456,506

[45] Date of Patent: Oct. 10, 1995

[54] SAFETY HASP HOLDER

[76] Inventor: Charles L. Bartlett, 1521 E. New York Ave., De Land, Fla. 32724

[21] Appl. No.: 217,860

[22] Filed: Mar. 25, 1994

[51] Int. Cl.[6] ..... E05C 19/08

[52] U.S. Cl. ..... 292/281; 292/201; 16/223

[58] Field of Search ..... 292/281, 285, 292/282, 251.5, 205, 283, 284, 201, 286, 208; 16/223, 365

[56] References Cited

U.S. PATENT DOCUMENTS

| | | | |
|---|---|---|---|
| 1,141,542 | 6/1915 | Hart | 292/285 |
| 2,673,755 | 3/1954 | Asp | 292/251.5 X |
| 3,279,829 | 10/1966 | Kurtenacker et al. | 292/281 X |
| 3,539,214 | 11/1970 | Fisher | 292/251.5 |
| 3,562,850 | 2/1971 | Eliason et al. | 292/251.5 X |
| 3,805,325 | 4/1974 | Lee | 16/223 X |
| 3,806,179 | 4/1974 | Roessle | 292/283 X |
| 4,331,356 | 5/1982 | Noel | 292/281 |

*Primary Examiner*—Rodney M. Lindsey
*Attorney, Agent, or Firm*—Macdonald J. Wiggins

[57] ABSTRACT

A hinged safety hasp has a hasp plate, a hasp leaf, a staple plate, and a magnet plate. The staple plate and the magnet plate are hingedly attached to the hasp leaf and are to be attached by screws to a surface in an opposing configuration by. The magnet plate includes a flat magnet on its surface. When the hasp is open, the hasp leaf is folded back to contact the magnet, thereby maintaining the hasp plate in a safe position to prevent possible injury to a person contacting an extending hasp leaf.

5 Claims, 1 Drawing Sheet

SAFETY HASP HOLDER

BACKGROUND OF THE INVENTION

1. Field of the Invention

The present invention relates to safety hasps, and more particularly to a safety hasp having means for protecting persons from contact with the hasp when in an open position.

2. Brief Description of the Prior Art

Safety hasps have an elongate leaf with a slot for engaging a staple plate which holds a padlock when the hasp is in a locked condition. When the hasp is not locked, the hasp leaf is free to swing on its hinge. This situation represents a safety hazard. If the leaf becomes extended from its hinge plate, a person may come into bodily contact therewith. Discomfort or injury may thus occur.

U.S. Pat. No. 4,331,356 teaches a hasp with a spring clip member for holding the hasp leaf against the mounting surface when the hasp is open. A coil spring is disclosed for such purpose in U.S. Pat. No. 3,562,850. However, the present invention provides an improved safety hasp that maintains the hasp leaf in a safe position when not in use and can be produced at a lower cost than the above mentioned prior art devices.

SUMMARY OF THE INVENTION

The safety hasp of the invention includes a three-piece steel hasp leaf assembly having a hasp leaf, a hasp plate, and a magnet plate portion and a staple plate. A hinge is common to the hasp leaf, the hasp plate, and the magnet plate. The hasp plate is used for attaching the hasp to a structure. The magnet plate is in opposed relationship to the mounting hasp plate when mounted. The hasp leaf is pivoted at its proximal end to the hasp plate and to the magnet plate. The distal end of the hasp plate has a slot for engaging the staple of the staple plate.

In use, the hasp plate is screwed to a wall adjacent a door such that the screws will be covered when the hasp plate is in the locking position. The magnet plate includes a small, flat magnet along its distal edge with its proximal edge common with the hinge. The magnet plate is attached to the wall by screws. The staple plate is attached to the door face in a position to accept the hasp plate slot.

During use, the hasp leaf engages the staple of the staple leaf thereby covering the hasp plate screws and staple plate screws, as known in the art. When the hasp is unlocked, the hasp leaf is swung back, permitting the leaf to contact the magnet. This action causes permits the magnet to hold the leaf essentially parallel with the wall, thus preventing the hasp leaf from swinging outward. This feature prevents possible injuries caused to persons making accidental contact with an extending hasp leaf.

It is therefore a principal object of the invention to provide a hasp in which the hasp leaf is maintained captivated against a wall when the hasp is open to prevent a person from coming into accidental contact therewith.

It is another object of the invention to provide a hasp having a magnet for holding a hasp leaf in a safe position to prevent the hasp leaf from becoming a safety hazard.

It is yet another object of the invention to provide a hinge in common with the hasp leaf, the hasp plate, and the magnet plate.

These and other object and advantages of the invention will become apparent from the following detailed description when read in conjunction with the drawings.

DETAILED DESCRIPTION OF THE PREFERRED EMBODIMENT

Figure 1:
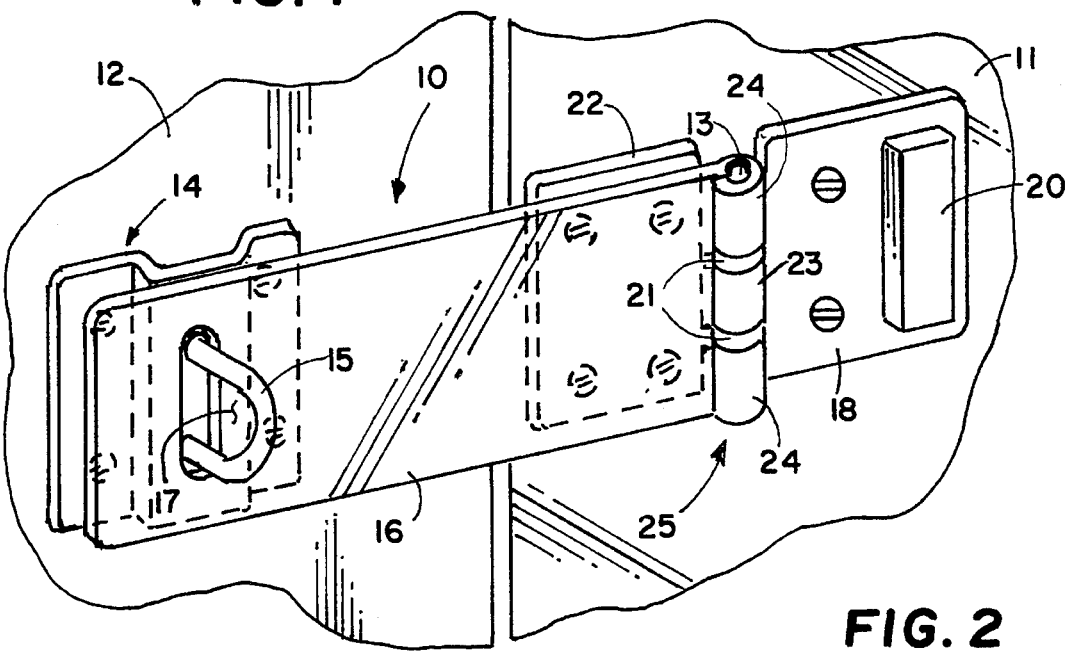
FIG. 1 is a perspective view of a typical safety hasp in accordance with the invention, shown installed at a door with the hasp shown in the locking portion.

A preferred embodiment of the safety hasp 10 in accordance with the invention is shown in FIG. 1, installed on a wall 11 and door 12. Hasp 10 is in position for installing a padlock in staple 15 of staple plate 14. Hasp 10 is formed of a ferrous material such as steel, that is strongly attracted by a magnet. Hasp 10 includes hasp mounting plate 22 attached to wall 11 by suitable screws. Mounting plate 22 includes a hinge sleeve portion 23 at its proximal edge. A magnet plate 18 includes a pair of hinge sleeve portions 21 at its proximal edge and mounting screws for attaching magnet plate 18 to wall 11. A bar magnet 20 is cemented, or otherwise attached, to an outer edge of magnet plate 18. Hasp leaf 16 has a pair of hinge sleeve portions 24. Pivot pin is 13 disposed through sleeve portions 24, 21, and 23 to form hinge 25. Staple 15 extends through slot 17 in hinge leaf 16 for attachment of a padlock.

Figure 2:
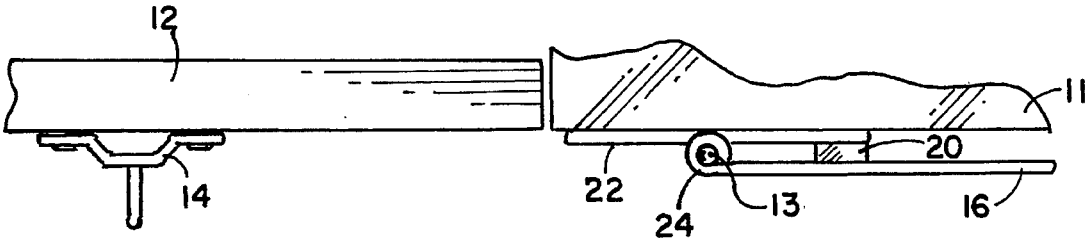
FIG. 2 is a top view of the safety hasp in the open position, with the hasp leaf portion held in a safe position by a magnet.

A top view of the hasp 10 attached to wall 11 and door 12 is shown in FIG. 2, with hasp leaf 16 in the open position. As will be understood, when door 12 is unlocked, hasp leaf 16 is swung back, permitting the face portion thereof to contact bar magnet 20. Magnet 20 thus captivates leaf 16 in a safe condition, yet leaf 16 is easily closed when locking of the door is required.

Figure 3:
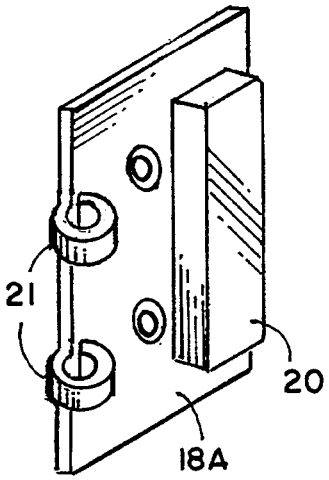
FIG. 3 is a perspective view of a magnet plate of the invention.

Additional details of the construction of magnet plate 18 is shown in the perspective view of FIG. 3. As may be noted, hinge sleeve portions 21 are formed as a portion of flat section 18A.

Figure 4:
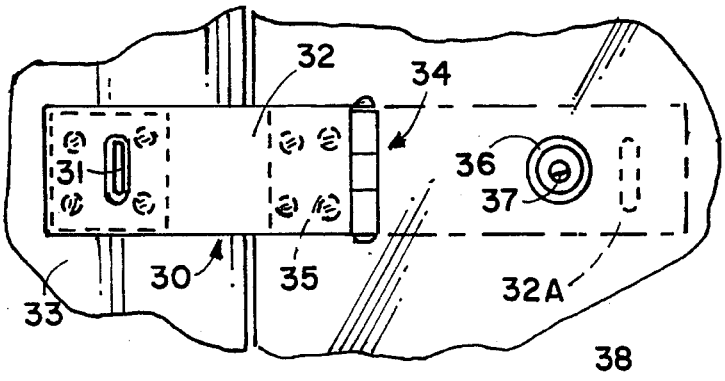
FIG. 4 is a plan view of an alternative version of the safety hasp of the invention in the closed position, showing a circular magnet attached to the wall adjacent the hasp hinge.

An alternative embodiment of the invention is shown in plan view in FIG. 4, with hasp 30 in the closed position, preparatory to installing a padlock. Hasp leaf 32 is attached to wall 31 by hinge plate 35. Hasp staple 31 is attached to door 33. As will be recognized, hasp 30 may be a prior art hasp and attached to a wall and door in conventional fashion. In accordance with the invention, a circular magnet 36 is attached to wall 38, preferably by a screw 37. Magnet 36 is spaced from hinge 34 so as to permit the face of hasp leaf 32 to contact magnet 36 when open and folded back thereagainst as shown in phantom view 32A.

As will now be recognized, the hasp leaf of the invention can be quickly and easily captivated against a wall when open, thereby preventing any damage or injury to persons by the hasp leaf such as could occur if the hasp leaf were not constrained, but allowed to swing outward and project from the wall. Although a particular mechanical arrangement of the safety hasp of the invention has been disclosed, various modifications can be made thereto without departing from the spirit and scope of the invention.

I claim:

1. A safety hasp comprising:

a) a ferrous hasp leaf having first hinge sleeves formed in a proximal end thereof;

b) a hasp mounting plate for attachment to a first surface, said hasp mounting plate having a second hinge sleeve formed along one edge thereof;

c) a magnet plate for attachment to said first surface, said magnet plate having third hinge sleeves formed along one edge thereof whereby said first hinge sleeves, said second hinge sleeve, and said third hinge sleeves having a hinge pin disposed therethrough;

d) a permanent magnet attached to said magnet plate;

e) a staple plate having a projecting staple for attachment to a second surface, said hasp leaf having a slot in a distal end thereof for accepting said staple of said staple plate when said hasp leaf is in a first, closed position; and f) a hinge formed by said first, second and third hinge sleeves, and said hinge pin, permitting said hasp leaf to be moved from said first, closed position to a second, open position whereby said magnet serves to hold said hasp leaf in said open position.

2. The safety hasp as defined in claim 1 in which said permanent magnet is rectangular in shape.

3. The safety hasp as defined in claim 1 in which said magnet is a bar magnet.

4. The safety hasp as defined in claim 1 in which said permanent magnet is essentially circular in shape.

5. A safety hasp for locking first and second surfaces together, and for maintaining said hasp in a safe position when in an unlocked condition comprising:

a) a hasp leaf, a mounting plate, and a magnet plate, an edge of each having a common hinge, said mounting plate and said magnet plate having means for attachment to said first surface;

b) a permanent magnet attached to said magnet plate wherein said magnet holds said hasp leaf adjacent said first surface when said hasp is in an open position; and c) a staple plate for attachment to said second surface for accepting said hasp leaf.

* * * * *